US006130021A

United States Patent [19]

Patel et al.

[11] Patent Number: 6,130,021

[45] Date of Patent: Oct. 10, 2000

[54] TONER PROCESSES

[75] Inventors: Raj D. Patel, Oakville; Michael A. Hopper, Toronto, both of Canada

[73] Assignee: Xerox Corporation, Stamford, Conn.

[21] Appl. No.: 09/058,872

[22] Filed: Apr. 13, 1998

[51] Int. Cl.[7] ..... G03G 9/08

[52] U.S. Cl. ..... 430/137; 523/335

[58] Field of Search ..... 430/137; 523/335

[56] References Cited

U.S. PATENT DOCUMENTS

| | | | |
|---|---|---|---|
| 3,674,736 | 7/1972 | Lerman et al. | 260/41 R |
| 4,137,188 | 1/1979 | Uetake et al. | 252/62.1 P |
| 4,550,131 | 10/1985 | Yats | 523/335 |
| 4,558,108 | 12/1985 | Alexandru | 526/340 |
| 4,623,678 | 11/1986 | Moore et al. | 523/335 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/107 |
| 5,650,255 | 7/1997 | Ng et al. | 430/137 |
| 5,650,256 | 7/1997 | Veregin et al. | 430/137 |

OTHER PUBLICATIONS

Schlarb, Bernhard et al. "Hydroresin dispersions: tailoring morphology of latex particles and films". Progress in Organic Coating (29), pp. 201–208, 1996.

Schlarb, Bernherd et al. "Hydroresin dispersions: new emulsifier free for aqueous coatings". Progress in Organic Coatings (26), pp. 207–215, 1995.

Grant, Roger & Claire Grant. Grant and Hackh's Chemical Dictionary, 5th Edition. New York: McGraw–Hill, Inc. p. 624, 1987.

*Primary Examiner*—Christopher D. Rodee
*Attorney, Agent, or Firm*—E. O. Palazzo

[57] ABSTRACT

A process involving the mixing of a latex emulsion containing resin and a surfactant with a colorant dispersion containing a nonionic surfactant, and a polymeric additive and adjusting the resulting mixture pH to less than about 4 by the addition of an acid and thereafter heating at a temperature below about, or equal to about the glass transition temperature (Tg) of the latex resin, subsequently heating at a temperature above about, or about equal to the Tg of the latex resin, cooling to about room temperature, and isolating the toner product.

21 Claims, No Drawings

TONER PROCESSES

PENDING APPLICATION AND PATENTS

Illustrated in U.S. Pat. No. 5,827,633 the disclosure of which is totally incorporated herein by reference is a process for the preparation of toner which process comprises for example, (i) preparing, or providing an aqueous colorant dispersion, which dispersion is comprised of a colorant and an ionic surfactant in water;

(ii) blending the colorant dispersion with a latex emulsion comprised of resin particles, a nonionic surfactant, and an ionic surfactant of opposite charge polarity to that of the ionic surfactant in said colorant dispersion;

(iii) heating the resulting mixture below about the glass transition temperature (Tg) of the latex resin to form toner sized aggregates;

(iv) heating the resulting aggregate suspension of (iii) above about the Tg of the latex resin; and (v) retaining the temperature in the range of from about 30° C. to about 95° C., and subsequently, adding an aqueous solution of boric acid, or an aqueous solution of a metal salt; adjusting the pH of the resulting reaction mixture to from about 9 to about 12 by the addition of a base, followed by the addition of a salicylic acid or catechol; and optionally, but preferably (vi) isolating, washing and drying the toner obtained.

In copending application U.S. Ser. No. 922,437, the disclosure of which is totally incorporated herein by reference, is, for example, a process for the preparation of toner comprising (i) aggregating with a metal complex, or metal ion a colorant dispersion with a latex emulsion and optional additives to form aggregates;

(ii) coalescing or fusing said aggregates; and optionally (iii) isolating, washing, and drying the toner.

In copending applications U.S. Ser. No. 960,754 now U.S. Pat. No. 5,944,650 and U.S. Pat. No. 5,766,818, the disclosures of each application being totally incorporated herein by reference, there is illustrated for example, emulsion/aggregation/coalescence processes wherein clevable surfactants are selected.

The appropriate components and processes of the copending applications may be selected for the processes of the present invention in embodiments thereof.

BACKGROUND OF THE INVENTION

The present invention is generally directed to toner processes, and more specifically, to chemical processes which involve the aggregation and fusion of latex, colorant, like pigment and additive particles into toner particles, and wherein aggregation can be controlled by adjusting, or decreasing the pH which is in the range of 4.5 to 6, to about 2 to 4 of the mixture of latex and colorant dispersion by the addition of an acid, and wherein there is selected a latex comprised of for example, submicron resin particles in the size range of 0.1 to 0.4 microns in volume average diameter, suspended in an aqueous phase of water, nonionic and anionic surfactants to which a colorant dispersion comprising for example, submicron colorant particles in the size range of 0.08 to 0.3 microns in volume average diameter, cationic surfactant, and a hydrodispersed polymer wherein the hydrodispersed polymer refers to a polymer resin containing a large number of acid groups in the range of for example, about 20 to about 300, and more specifically from about 30 to about 250 of acid groups and which resin can be dispersed or solubilized in an aqueous media, which media is in a pH range of about 7 to about 12. The acid groups can be comprised of acrylic acid, maleic acid, methacrylic acid, itaconic acid and the like, and which acids are incorporated into the backbone of the polymer chain during the polymerization process, and more specifically the acid groups are for example, JohncrylTM available from S.C Johnson & Son, UnicidTM from Petrolite, acrylate—acrylic and styrene butadiene emulsions from Dow Chemicals and which are generally considered styrene acrylic polymers.

The toners generated with the processes of the present invention can be selected for known electrophotographic imaging and printing processes, including digital processes.

In xerographic systems, especially color systems, small sized toners of preferably from about 2 to about 7 microns are important to the achievement of high image quality for process color applications. It is also important to have a low image pile height to eliminate, or minimize image feel and avoid paper curling after fusing. Paper curling can be particularly pronounced in xerographic color processes primarily because of the presence of relatively high toner coverage as a result of the application of three to four color toners. During the fusing step, moisture escapes from the paper due to high fusing temperatures of from about 120° C. to 200° C. In the situation wherein with only one layer of toner is selected, such as in one-color black or highlight color xerographic applications, the amount of moisture driven off during fusing can be reabsorbed by the paper and the resulting print remains relatively flat with minimal paper curl. In process color where toner coverage is high, the relatively thick toner plastic covering on the paper can inhibit the paper from reabsorbing the moisture, and cause substantial paper curling. These and other imaging shortfalls and problems are avoided or minimized with the toners and processes of the present invention.

Also, it is preferable to select a toner particle sizes, such as from about 2 to about 7 microns, and with a high colorant, especially pigment loading such as from about 4 to about 15 percent by weight of toner, so that the mass of toner necessary for attaining the required optical density and color gamut can be significantly reduced to eliminate or minimize paper curl. Lower toner mass also ensures the achievement of image uniformity. However, higher pigment loadings often adversely affect the charging behavior of toners. For example, the charge levels may be too low for proper toner development or the charge distributions may be too wide and toners of wrong charge polarity may be present. Furthermore, higher pigment loadings may also result in the sensitivity of charging behavior to charges in environmental conditions such as temperature and humidity. Toners prepared in accordance with the processes of the present invention minimize, or avoid these disadvantages.

PRIOR ART

Processes are known for toner preparation, such as, for example, conventional processes wherein a resin is melt blended or extruded with a pigment, micronized and pulverized to provide toner particles. The average volume particle diameter which can be cost-effectively produced by conventional processes are generally over 8 or 9 microns with a typical GSD of over 1.4. In these conventional process, it is therefore important to subject the toners to a size classification to achieve a decreased GSD to a more acceptable level of for example, about 1.35, to thereby provide reasonable image quality. In general, two to three classification cycles may be needed, and the toner yields after classification can range from about 40 percent to about 90 percent depending the toner size and GSD requirements. For toners with average particle size diameters of from about 11 microns to about 15 microns, toner yields range from about 70 percent to about 85 percent after classification. For smaller sized toners in excess of about 8 micron toners, lower yields of about 50 to 80 percent can result after classification. With the processes of the present invention in embodiments, small toner sizes of, for example, from about 2 to about 7 microns, and GSD of less than about 1.35, and more specifically less than about 1.25 can be obtained without classification processes. Since no classification is needed with the processes of the present invention, in embodiments small toners of from about 2 micron to about 7 microns can be economically prepared in yields of about 90 percent, or greater.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles are obtained hence it is believed that classification is required resulting in low toner yields. In U.S. Pat. No. 4,797,339, there is disclosed a process for the preparation of toners by resin emulsion polymerization, wherein similar to the '127 patent certain polar resins are selected; and U.S. Pat. No. 4,558,108, discloses a process for the preparation of a copolymer of styrene and butadiene by specific suspension polymerization. Other prior art that may be of interest includes U.S. Pat. Nos. 3,674,736; 4,137,188 and 5,066,560.

Emulsion/aggregation/coalescense processes for the preparation of toners are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,346,797, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935 (spherical toners).

The appropriate components and processes of the above Xerox patents and copending applications can be selected for the processes of the present invention in embodiments thereof.

SUMMARY OF THE INVENTION

Aspects of the present invention include a process for the preparation of toner comprising blending a latex emulsion containing resin, colorant, and a polymeric additive; adding an acid to achieve a pH of about 2 to about 4 for the resulting mixture; heating at a temperature about equal to, or about below the glass transition temperature (Tg) of the latex resin; optionally adding an ionic surfactant stabilizer; heating at a temperature about equal to, or about above about the Tg of the latex resin; and optionally but preferably cooling, isolating, washing, and drying the toner; a process wherein the blend of the latex emulsion containing resin, colorant and a polymeric additive, possesses a pH of about 4.5 to about 6, the colorant is in the form of an aqueous dispersion, the heating and stirring the resulting mixture at a temperature about equal to, or about below the glass transition temperature (Tg) of the latex resin enables the formation of toner sized aggregates; the heating at a temperature about equal to, or about above about the Tg of the latex resin enables the fusion or coalescence of the components of aggregates; a process wherein there is accomplished stirring with said heating of the resulting mixture at a temperature about equal to, or about below the glass transition temperature (Tg) of the latex resin; said ionic surfactant stabilizer is added prior to the heating above the resin glass transition temperature and the toner is isolated, washed, and dried; a process wherein the polymeric additive preferably in the colorant dispersion is a hydroresin; a process wherein said hydroresin contains a high number, from about 20 to about 300, of acid groups; a process wherein about 25 to about 250 acid groups are present, and there is enabled dissipation of the latex resin in a aqueous media, and wherein the aqueous media is water and the obtained hydroresin dispersion in water has a pH range of about 7 to about 12; a process wherein the polymeric additive is in the form of a water dispersion, or in the form of an emulsion; a process wherein the water dispersion contains from about 80 to about 50 percent water, and from about 20 to about 50 percent of polymer additive, and which additive is comprised of submicron styrene acrylic polymeric resin particles which are about 0.08 to about 0.3 microns in volume average size and wherein the emulsion contains about 30 to about 50 weight percent solids in about 70 to about 50 weight percent of water; a process in wherein the polymeric additive is a styrene acrylic resin, an acrylate acrylic resin, or a butadiene acrylic resin; a process wherein said hydroresin is readily dispersed or dissipated in a base solution of sodium hydroxide, poassium hydroxide, or ammonium hydroxide; a process wherein the polymeric additive is in the form of a low volatile organic component and is comprised of acrylic resins and wherein the volatility is less than about 1 or about 0.05 to about 1 and wherein said additive possesses an acid number of from about 100 to about 400; a process wherein the polymeric additive is in the form of a rhelogy controlled (RC) or a material exhibiting newtonian behavior, and which additive is comprised of an acrylic polymer, or a styrene-anted acrylic polymer with an acid number in the range of about 15 to about 100; a process wherein the additive is of a Mw of from about 4,000 to about 300,000 and the additive Tg is from about −18 to about +75 degrees C.; a process wherein the additive is of a Mw of about 4,000 to about 200,000 and additive Tg is about −16 to about +70 deg C.; a process wherein the polymeric additive is selected in an amount of from about 2 to about 18 weight percent; a process comprising providing or preparing a latex emulsion which latex comprises resin particles, a nonionic surfactant, and ionic surfactant; (i) blending said latex emulsion with a colorant dispersion comprised of colorant particles stabilized by a nonionic surfactant, and a polymeric additive, an ionic surfactant of opposite charge polarity to that of the ionic surfactant in said latex emulsion; and reducing the latex pH to about 2 to about 4 by adding an acid; (ii) heating the resulting mixture below the glass transition temperature (Tg) of the latex resin particles; (iii) heating resulting aggregate suspension of (iii) above the Tg of the latex resin particles in the presence of an aggregate stabilizer; and isolating the toner product; a process wherein the colorant is in the form of a dispersion of colorant particles and which particles are stabilized by a hydroresin and isolating, washing, and drying; a process wherein said toner is prepared by blending the colorant in the form of a dispersion with said latex emulsion by a high shearing device, and wherein the colorant dispersion is a pigment dispersion stabilized by a nonionic surfactant and optionally stabilized by submicron of about 0.05 to about 0.2 microns in volume average diameter, hydroresin particles and which colorant dispersion contains an ionic surfactant, and wherein the latex contains a nonionic surfactant and an ionic surfactant of opposite charge polarity to that of ionic surfactant in the colorant dispersion; followed by the reduction of the pH to from about 2 to about 3 by the addition of a dilute acid in the amount of about 0.5 to about 10 weight percent by weight of water; heating the resulting mixture at a temperature of about 30° C. to about 60° C. to effect formation of aggregates having a particle size of from about 2 to about 10 microns in volume average diameter with a narrow particle size distribution of from about 1.12 to about 1.25; heating the resulting aggregate suspension in the presence of an aggregate stabilizer to prevent, or minimize the aggregates from growing in size, and which heating is at a temperature of from about 65° C. to about 100° C.; and isolating the toner product, washing, and drying; a process wherein the product toner size is from about 2 to about 10 microns, and said toner possesses a particle size distribution of from about 1.12 to about 1.25; a process wherein the ionic surfactant in the colorant dispersion is a cationic surfactant, and the ionic surfactant present in the latex emulsion is an anionic surfactant; a process wherein the heating of the latex, colorant, and surfactants in the aggregation mixture is accomplished at a temperatures from about 15° C. to about 1° C. below the Tg of the latex resin for a duration of from about 0.5 hours to about 5 hours; and the subsequent heating of the aggregate suspension is accomplished at about 20° C. to about 50° C. above the Tg of the latex resin for a duration of about 1 hour to about 5 hours; a process wherein the latex contains a resin prepared by emulsion polymerization of vinyl monomers selected from the group consisting of styrene and substituted styrenes, 1,3-dienes, substituted 1,3-dienes, acrylates, methacrylates, acrylonitrile, acrylic acid, and methacrylic acid; a process wherein the latex contains a resin selected from the group consisting of poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly (styrene-butyl acrylate), poly(styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylonotrile), and poly(styrene-butyl acrylate-acrylonotrile-acrylic acid), and wherein the resin is optionally present in an effective amount ranging from 80 percent by weight to about 98 percent by weight of toner; a process wherein the emulsion resin size is from about 0.05 to about 1 micron in volume average diameter, and the colorant particle size is from about 0.01 to about 1 micron in volume average diameter; a process wherein the nonionic surfactant present in the latex emulsion is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; and wherein the anionic surfactant is selected from the group consisting of sodium dodecyl sulfate, sodium dodecylbenzene sulfate and sodium dodecylnaphthalene sulfate, and wherein the cationic surfactant is optionally a quaternary ammonium salt; a process wherein the nonionic, anionic and cationic surfactants are each present in an amount of from about 0.01 to about 5 weight percent of the total reaction mixture; a process wherein the colorant is carbon black, cyan, yellow, magenta, or mixtures thereof; a process wherein there is added to the surface of the formed toner metal salts, metal salts of fatty acids, silicas, metal oxides, or mixtures thereof, in an amount of from about 0.1 to about 10 weight percent; a process comprising mixing a latex emulsion containing resin and a surfactant with a colorant dispersion containing a nonionic surfactant, and a polymeric additive and which resulting mixture is adjusted to a pH of less than about 6 by the addition of an acid and thereafter heating at a temperature below about, or equal to about the glass transition temperature (Tg) of the latex resin, subsequently heating at a temperature above about, or about equal to the Tg of the latex resin; optionally cooling, and isolating the toner product; a process wherein there is selected a latex comprised of submicron resin particles suspended in an aqueous water phase of nonionic and anionic surfactants to which is added a colorant dispersion comprising submicron, for example less than, or equal to about 0.5 microns, colorant particles, cationic surfactant, and a hydroresin dispersion of water, and comprised for example of about 20 to about 50 weight percent of solids by weight of water, where the hydroresin is a polymer which is easily dispersed or solubilized in water under basic pH conditions, that is a pH of about 8 to about 12, and resulting in submicron particles, and wherein when these components are comprised of resin particles, colorant pigment particles, and hydroresin particles, when blended together result in a mixture with a pH in the range of 4.5 to 6.5, which pH is reduced to about 2 to about 4, and preferably about 2.3 to about 2.8 by the addition of an acid, such as citric acid and when further aggregated by stirring and heating the resultant blend from about 5 to 10 degrees below the resin Tg, there results after heating above the Tg toners with a narrow GSD for example about 1.25, or less, and which improved GSD enables the clean transfer of the toner particles in xerographic systems thereby providing enhanced resolution of the fused images; processes for the preparation of black and colored toner compositions by the aggregation and coalescence/fusing of a latex comprised of submicron resin, that is for example in the size range of about 0.08 to about 0.5 microns and preferably from about 0.1 to 0.3 microns in volume average diameter as measured by a Coulter Counter, such resins including for example, styrene butylacrylate acrylic acid suspended in an aqueous phase with a solids loading of 40 weight percent by weight of water, and containing nonionic and anionic surfactants, and colorant comprising submicron in the size range of about 0.08 to about 0.3 microns colorant particles for example Blue 15.3, cationic surfactant such as Sanizol B, and a hydroresin where the hydroresin refers for example to a resin containing a large number of acid groups in the range of about 20 to about 130, and more specifically about 50 to about 100, thereby permitting the rapid dispersion or solubilization of the resin into submicron particles when the pH is in the range of about 7 to 12 and preferably in the range of 8 to 11.5; and which hydroresin polymers, or resins are for example, acrylic acid, maleic acid, methacrylic acid, itaconic acid and the like, and wherein these components when blended together result in a mixture with a pH in the range of about 4.5 to about 6.5 and which pH is reduced to about 2 to about 4 by the addition of an acid, and stirring and heating below the glass transition temperature of the resin (Tg), where the heating is in the range of about 5 to about 20 degrees centigrade below the resin Tg, to form toner size aggregates comprised of resin and colorant, cooling and heating at about equal to, or about above the resin Tg to fuse the aggregates, and then isolating and washing the toner to remove surfactants, and wherein the colorant may be passivated; processes wherein the latex and colorant dispersion can be mixed together at high speeds using devices such as a polytron; processes for the preparation of toner compositions with certain effective particle sizes by properly controlling the temperature of the aggregation and which processes comprise heating a mixture of latex and colorant particles in the presence of suitable surfactants at a temperature below the glass transition temperature (Tg) of the latex resin to form toner sized aggregates, followed by heating above the resin Tg to form mechanically stable toner particles, and wherein there is provided a toner with a narrow particle size distribution as characterized by a GSD of less than about 1.35, and preferably less than about 1.20 to about 1.25 as measured by the Coulter Counter; wherein the toner is of small particle size of from about 2 to about 8 microns in volume average diameter, and in overall process yields of from about 80 percent to over 98 percent without conventional size classification, and wherein a high toner charge of for example, a negative about 20 to 40 $\mu$C/gram against a suitable carrier is achievable, and wherein there are provided toner compositions with excellent color mixing properties and high image projection efficiencies of in excess of about 70 percent as measured by the Match Scan II spectrophotometer available from Milton-Roy; toner processes comprising aggregating a latex containing a copolymer host resin, colored particles coated and stabilized by a surfactant or optionally stabilized by a hydroresin, reducing the pH to about 2 to about 4 and forming toner sized aggregates at a temperature about equal to, or about below about the Tg of the latex resin, followed by coalescence of the aggregates at a temperature about equal to, or about above the Tg of the resin to form mechanically robust toner particles, and wherein the aggregate size, and thus the toner size is primarily controlled by the temperature at which the aggregation is conducted, and optionally but preferably adding during, or prior to coalescence a stabilization agent, which minimizes, or prevents the aggregates from growing in size, and preferably wherein after coalescence, the reaction mixture is cooled, usually to room temperature, about 25 degrees Centigrade, followed by isolation of the toner product, and thereafter washing the toner isolated primarily to remove surfactants, and subsequently drying in an oven, a freeze dryer, spray dryer, or fluid bed; aggregation/coalescence toner process comprising (i) blending a latex emulsion comprised of submicron resin particles of for example, styrene/butylacrylate/acrylic acid suspended in an aqueous solution of anionic, nonionic and a hydrolyzable clevable nonionic surfactant and wherein the pH of the latex is in the range of 1.5 to 2 and a pigment dispersion comprised of submicron pigment particles stabilized by a nonionic surfactant or optionally stabilized by a hydroresin such as styrene acrylic polymer containing a large number of acid groups and a cationic surfactant, thereby causing a flocculation of latex and colorant, like pigment particles primarily as a result of the destabilization caused by neutralization of oppositely charged surfactants;

(ii) adjusting the pH of the mixture resulting to about 2 to 3 by the addition of an acid such as citric acid;

(iii) heating the resulting flocculent mixture at a temperature of about 30° C. to about 60° C., thereby inducing formation of toner sized aggregates and which aggregates are comprised of latex particles comprised for example of styrene butylacrylate acrylic acid, and optionally a hydroresin, colorant particles, such as pigment particles, and surfactants, and wherein the aggregate size is for example, from about 2 microns to about 20 microns in volume average diameter with a GSD of less than about 1.30, and more specifically from about 1.14 to about 1.24;

(iv) effecting by heating coalescence of the resulting aggregates to form mechanically stable integral toner particles, which heating is preferably accomplished in the presence of additional anionic surfactant, at a temperature of from about 65° C. to about 100° C. for a duration of for example, about 30 minutes to about 10 hours; (iv) cooling, isolating the toner by known methods, such as filtration, washing with water, or an aqueous base solution the resulting toner to remove surfactants with and drying; and the preparation of toner particles containing hydroresin in an amount of about 5 to about 20 weight percent by weight of solids, in the amount of about 6 to about 15 weight percent by weight of total solids, and wherein the hydroresin can be for example a styrene acrylic, an acrylate acrylic, a butadiene acrylic, and the like, all with a high number of acid groups for example, in the range of about 20 to about 130 and preferably in the range of about 25 to about 120, and wherein also the hydroresins can be selected based on the physical properties thereof, such as high molecular weight Mw in the range of 30,000 to about 300,000, a low Tg in the range of about −18 degrees Centigrade to 35 degrees Centigrade, Mn in the range of about 4,000 to about 30,000, a high Tg, in the range of about 40 to about 80 degrees Centigrade, and the like.

With the present invention of importance is for example the reduction or decrease of the pH of the blended mixture, which can initially range from about 4.5 to about 6.5, to about 2 to about 4, and more specifically to about 1.8 to about 3.0 by the addition of an acid such as citric acid. It is believed that the narrowing GSD of the toner size distribution results from the decrease in the pH by the addition of an acid, such as citric acid wherein for example the acrylic acid becomes ionized and highly charged therefore allowing the submicron negatively charged latex and positively charged colorant and hydroresin particles to aggregate, thereby resulting in a narrow size distribution. Also, the solubility of for example, the acrylic acid may be a factor, wherein at pH of about greater than about 3 and especially at pH of about 4 results in acrylic acid being soluble and hence less from about 40 to 70 percent of acrylic acid is available on the surface. Further, of importance with respect to the present invention is the selection of the hydroresin or polymeric modifiers for the latex, or colorant dispersion and which hydroresin or polymeric modifiers are preferably water dispersions, or emulsions of acrylics, such as styrene acrylic copolymers. Specifically the hydroresins can be comprised of styrene acrylic, acrylate acrylics, butadiene acrylics, styrene acrylate acrylics, and butadiene isoprene acrylics, each with a molecular weight Mw in the range of about 4,000 to about 300,000 and a Tg in the range of about −18 degrees Centigrade to about 70 degrees Centigrade and with an acid number in the range of about 20 to about 300 for effective solubilization or dissipation in a base solution in a pH range of 7 to 12. Preferred hydroresins are styrene acrylates, acrylic butadiene acrylics, and acrylate acrylics, commercially available from for example, S.C Johnson, E.I. Du Pont, and Baker Petrolite. Various suitable amounts of the polymeric modifiers or hydroresin can be selected, such as for example, from about 2 to about 30 weight percent, and preferably from about 3 to about 15 and which weight percent is obtained based on the amount of modifier or hydroresin divided by the amount of latex plus the amount of polymeric modifier. The hydroresins are available in the form of resin solutions of for example, acrylic resin in organic solvents where the solvent is in the range of 2 to 20 weight percent, low volatile organic compounds (VOC) containing polyols such as Joncryl 50, 55, 57, 60, 63, 70, 73, 500 & 510, all containing volatile compounds which are present in <1 weight percent, and can be utilized as sole vehicles or used in combination with other resins, for example styrene butylacrylate acrylic acid in coating industries and as leveling agent, and emulsions of rhelogy controlled or materials exhibiting Newtonian behavior wherein the emulsions exhibit solution like viscosity, both at high and low shear rates. Examples of such materials are Joncryl 77, 80, 87, 97, 98, 130, 134, 138, 537, 538, SCX 2502, 2560 all available from Johnson & Son, and colloidal emulsions, of Acrylate acrylic emulsions such as DM100NA Acrylate emulsions TDS, DM211 NA Acrylate emulsion TDS, DA 30NA Acrylic emulsion TDS, styrene butadiene for example DM 171NA, DI 313NA, DL 215NA, DI 240NA, Latex 460NA, DL 233NA available from Dow Chemicals, wherein the solids are in the range of 30 to 55 percent W/W of water.

The present invention further resides in providing a toner process with a narrow particle size distribution using less cationic surfactant than that described in for example, U.S Pat. No. 5,364,729, and wherein the amount of cationic surfactant selected is preferably, but need not be, less than the amount of anionic surfactant present.

Illustrative examples of latex resins or polymers selected for the process of the present invention include known polymers such as poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly (styrene-butyl acrylate), poly(styrene-butadiene-acrylic acid), poly(styrene-butadiene-methacrylic acid), poly (styrene-butyl acrylate-acrylic acid), poly(styrene-butyl acrylate-methacrylic acid), poly(styrene-butyl acrylate-acrylonitrile), poly(styrene-butyl acrylate-acrylonotrile-acrylic acid), and the like. A preferred resin, or polymer is a styrene/butyl/acrylic acid terpolymer. The resin selected in embodiments is present in various effective amounts, such as for example, from about 85 weight percent to about 98 weight percent of toner, and the latex particle size can be for example, from about 0.05 micron to about 1 micron in average volume diameter as measured by the Brookhaven nanosize particle analyzer. Other sizes and effective amounts of latex particles may be selected in embodiments.

The latex resin selected for the process of the present invention is preferably prepared by emulsion polymerization methods, and the monomers utilized in such processes preferably include styrene, acrylates, methacrylates, butadiene, isoprene, acrylonitrile, acrylic acid, and methacrylic acid. Known chain transfer agents, for example dodecanethiol in effective amounts of for example from about 0.1 to about 10 percent, and/or carbon tetrabromide in effective amounts of from about 0.1 to about 10 percent, can also be employed to control the resin molecular weight during the polymerization. Other processes of obtaining resin particles of from, for example, about 0.05 microns to about 1 microns can be selected from polymer microsuspension process, such as the processes disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding processes, or other known processes.

Various known colorants, such as dyes, pigments, mixtures of dyes, mixtures of pigments, mixtures of pigments and dyes, other known suitable colorants, and especially pigments present in the toner in an effective amount of, for example, from about 1 to about 15 percent by weight of the toner, and preferably in an amount of from about 3 to about 10 weight percent, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, or dyes there can be selected cyan, magenta, yellow, red, green, brown, blue pigment or mixtures thereof. Specific examples of colorants include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are cyan, magenta, and yellow, black, red, green, orange, brown, blue, and mixtures thereof. Examples of magentas include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows s that may be selected are diarylide yellow 3,3-dichlorobenzidene acetoacetanilides, a mono azo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention.

Colorant refers to pigments, dyes, mixtures thereof, mixtures of pigments, mixtures of dyes, and the like.

Surfactants in amounts of, for example, from about 0.01 to about 20, or more specifically from about 0.1 to about 15 weight percent of the reaction mixture in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example, from about 0.01 to about 10 percent by weight, and preferably from about 0.1 to about 5 percent by weight of the reaction mixture.

Examples of ionic surfactants include anionic and cationic with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of the reaction mixture Cationic surfactant examples selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.01 percent to about 5 percent by weight of the reaction mixture, however this amount can be reduced by about 30 to about 50 percent when there is selected for the latex a polymeric additive, such as styrene acrylate acrylic acid, acrylic resins, acrylate acrylic resins, a hydroresin of for example, Johncryl™ available from S.C Johnson & Son, butadiene emulsions available from Dow Chemicals, Unicid available from Baker Petrolite and similar hydroresins. Preferably, thus the amount of cationic surfactant is about 0.5 to about 0.75, and the molar ratio of the cationic surfactant used for flocculation to the anionic surfactant used in the latex preparation is in the range of from about 0.5 to about 10, and preferably from about 1 to about 5 weight percent based on the w/w of water.

Examples of the additional surfactant, which may be added to the aggregate suspension prior to, or during the coalescence to for example, prevent the aggregates from growing in size, or for stabilizing the aggregate size, with increasing temperature can be selected from anionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. These surfactants can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-72™, IGEPAL CO-890™, IGEPAL CO-720™, IGEPAL CO-290™, IGEPAL CA-210™, ANTAROX 890™ and ANTAROX 897™. An effective amount of the anionic or nonionic surfactant generally employed as an aggregate size stabilization agent is, for example, from about 0.01 to about 10 percent by weight, and preferably from about 0.1 to about 5 percent by weight of the reaction mixture.

Examples of the acids that can be utilized as for example, coagulants include nitric acid, sulfuric acid, hydrochloric acid, acetic acid, citric acid, trifluro acetic acid, succinic acid, salicylic acid and the like, and which acids are preferably utilized in a diluted form in the range of about 0.5 to about 10 weight percent by weight of water and preferably in the range of about 0.7 to about 5 weight percent of water.

Surface additives that can be added to the toner compositions to primarily improve their powder flow properties include, for example, metal salts, metal salts of fatty acids, colloidal silicas, metal oxides, such as titanium oxides, tin oxides, other known additives, mixtures thereof and the like, which additives are usually each present in an amount of for example, from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and silicas, such as those available from Cabot Corporation and Degussa Chemicals, and more specifically AEROSIL R972® available from Degussa, each in amounts of from 0.1 to 2 percent, and which additives can be for example be added during the aggregation or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. The carriers selected may also contained dispersed in the polymer coating a conductive compound, such as a conductive carbon black and which conductive compound is present in various suitable amounts, such as from about 15 to about 65, and preferably from about 20 to about 45 weight percent.

Imaging methods are also envisioned with the toners of the present invention, reference for example U.S. Pat. No. 4,265,660, the disclosure of which is totally incorporated herein by reference.

By aggregation is meant for example, the flocculation of submicron resin and submicron colored particles and optionally submicron polymeric additives or hydroresin particles; by coalescence is meant for example, the fusing of the components of the aggregates to from mechanically robust particles, that is for example particles that withstand substantial deterioration in machine environments; by Tg is meant for example the glass transition temperature of the resin in degrees Centigrade; by toner is meant for example, a composition comprised of resin and colorant, and by hydroresin or polymer additive or a polymeric modifier is meant for example, a resin with a high number of acid groups attached on the backbone of the polymer, thereby allowing the resin to be hydro dispersed or solubilized in a basic media at a pH of about 7–12 and preferably in the pH of about 8–11.5. Also, the total of all components in the toner is about 100 percent, or 100 parts.

The following Examples are being submitted to further define various aspects of the present invention. These Examples are intended to be illustrative only and are not intended to limit the scope of the present invention.

Latex Preparation: LATEX A

A latex emulsion comprised of polymer particles generated from the emulsion polymerization of styrene, butyl acrylate and acrylic acid was prepared as follows. A mixture of 2,255 grams of styrene, 495 grams of butyl acrylate, 55.0 grams of acrylic acid, 27.5 grams of carbon tetrabromide and 96.25 grams of dodecanethiol was added to an aqueous solution prepared from 27.5 grams of ammonium persulfate in 1,000 milliliters of water and 2,500 milliliters of an aqueous solution containing 62 grams of anionic surfactant, NEOGEN R™ and 33 grams of poly(ethylene glycol)-α-methyl ether-ω-methyl p-tert-octylpHenyl pHospHate hydrolyzable cleavable nonionic surfactant. The resulting mixture was emulsified at room temperature, about 25° C., under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer of poly(styrene-co butyl acrylate-co-acrylic acid) possessed an $M_w$ of 29,300, and an $M_n$ of 7,212, as measured by Gel Permeation ChromatograpHy, and a mid-point Tg of 55.6° C. (Centigrade) as measured using Differential Scanning Calorimetry.

Latex Preparation: LATEX B

A latex emulsion comprised of polymer particles generated from the emulsion polymerization of styrene, butyl acrylate and acrylic acid was prepared as follows. A mixture of 2,255 grams of styrene, 495 grams of butyl acrylate, 55.0 grams of acrylic acid, 27.5 grams of carbon tetrabromide and 96.25 grams of dodecanethiol was added to an aqueous solution prepared from 27.5 grams of ammonium persulfate in 1,000 milliliters of water and 2,500 milliliters of an aqueous solution containing 62 grams of anionic surfactant, NEOGEN R™ and 33 grams of ANTAROX™ CA897. The resulting mixture was emulsified at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer possessed an $M_w$ of 30,500, an $M_n$ of 6,900, as measured by Gel Permeation ChromatograpHy, and a mid-point Tg of 54.9° C. measured by differential scanning calorimetry.

Toner Preparation

EXAMPLE I 240.0 Grams of the latex A having a pH of 1.8 as measured by an Orion pH meter and 220.0 grams of an aqueous water cyan pigment dispersion (53.4% cyan solids) having a pH of 8.5 and containing 4.0 grams of Cyan Pigment 15.3 and 1.5 grams of cationic surfactant, SANIZOL B™, and 22 grams of a hydrodispersed the styrene acrylic emulsion of 40 weight percent solids were added to 400 milliliters of water with high shear stirring using a polytron. The resulting mixture's pH was found to be pH 5.8. The pH of the mixture was then reduced to 2.5 by the addition of 25 grams of a 10 weight percent solution of citric acid in water. The resulting mixture was then transferred to a 2-liter reaction vessel and heated at a temperature of 45° C. for 15 minutes resulting in a particle size of 5.5 microns with a GSD of 1.22 before 45 milliliters of a 20 percent aqueous NEOGEN R™ solution was added. Subsequently, the mixture was heated to 95° C. and held there for a period of 4.0 hours before cooling down to room temperature, and the pH of the mixture was adjusted to 8.5 with a 3.5 weight percent potassium hydroxide solution, and then stirred for 1 hour and filtered. The filter cake was redispersed in 1 liter of water with the aid of a mechanical stirrer, and the resulting toner slurry was brought to pH of 8.5 with 25 milliliters of 4 weight percent (w/w of water) dilute aqueous KOH solution, stirred for 60 minutes, and filtered. The filter cake was again redispersed in 1 liter of water, and the resulting toner slurry was brought to pH of 8.5 with 1 mls of 4 weight percent dilute aqueous KOH solution, stirred for 60 minutes, and filtered. The washing was repeated twice in the same manner with water only, and there resulted a toner of the above resin 97.25 percent by weight and pigment 3.75 percent by weight, and which toner possessed a particle size of 5.7 microns in volume average diameter and a particle size distribution of 1.21 as measured with a Coulter Counter.

The toner charging evaluation was performed according to the following procedure. In a 120 milliliters glass bottle, 1 gram of the prepared toner was added to 24 grams of carrier particles comprised of 65 micron steel core particles coated with a mixture of 20 percent by weight of VULCAN carbon black dispersed in 80 percent of poly(methyl methacrylate), and wherein the carrier coating weight was 1 percent. Samples, about 5 to 10 grams of the toner and carrier were retained in an environmental chamber at either 20 or 80 percent relative humidity for about 18 hours. The bottle was then sealed, and the contents were mixed by roll milling for 30 minutes to obtain a stable triboelectric charge. The toner charge was measured using the standard Faraday Cage tribo blow-off apparatus. For the toner of this Example, the tribo values at 20 and 80 percent relative humidity were, respectively, −51 and −23 microcoulombs per gram ($\mu$C/g).

EXAMPLE II 240.0 Grams of the latex A having a pH of 1.8 and 220.0 grams of an aqueous yellow pigment dispersion (28.8% solids) having a pH of 8.5 containing 9.2 grams of Yellow Pigment 17 and 1.8 grams of cationic surfactant, SANIZOL B™, and 22 grams of a hydrodispersed styrene acrylic emulsion with a solids loading of 52 weight percent were added to 400 milliliters of water with high shear stirring using a polytron. The resulting mixture's pH was found have a pH of 6.0. The pH of the mixture was reduced to 2.5 with the addition of 28 gms (grams) of 10 weight percent solution of citric acid in water. The resulting mixture was transferred to a 2-liter reaction vessel and heated at a temperature of 45° C. for 50 min resulting in a particle size of 5.4 microns with a GSD of 1.23 before 65 milliliters of a 20 percent aqueous NEOGEN R™ solution was added. Subsequently, the mixture was heated to 95° C. and held there for a period of 4.0 hours before cooling down to room temperature, and the pH of the mixture adjusted to 8.5 with a 3.5 weight percent w/w of water of potassium hydroxide stirred for 1 hr and filtered. The filter cake was redispersed in 1 liters of water with the aid of a mechanical stirrer, and the resulting toner slurry was brought to pH of 8.5 with dilute aqueous KOH solution, stirred for 60 minutes, and filtered. The filter cake was again redispersed in 1 liters of water, and the resulting toner slurry was brought to pH of 8.5 with dilute aqueous KOH solution, stirred for 60 minutes, and filtered. The washing was repeated twice in the same manner with water only, and there resulted a toner of the above resin 92.0 percent by weight and pigment 8.0 percent by weight, and which toner possessed a particle size of 5.8 microns in volume average diameter and a particle size distribution of 1.22 as measured with a Coulter Counter.

The toner charging evaluation was performed according to the following procedure. In a 120 milliliters glass bottle, 1 gram of the prepared toner was added to 24 grams of carrier particles comprised of 65 micron steel core particles coated with a mixture of 20 percent by weight of VULCAN carbon black dispersed in 80 percent of poly(methyl methacrylate), and wherein the carrier coating weight was 1 percent. Samples, about 5 to 10 grams of the toner and carrier were retained in an environmental chamber at either 20 or 80 percent relative humidity for about 18 hours. The bottle was then sealed, and the contents were mixed by roll milling for 30 minutes to obtain a stable triboelectric charge. The toner charge was measured using the standard Faraday Cage tribo blow-off apparatus. For the toner of this Example, the tribo values at 20 and 80 percent relative humidity were, respectively, −56 and −18 microcoulombs per gram ($\mu$C/g).

EXAMPLE III—(Black)

240.0 Grams of the latex A having a pH of 1.8 and 220.0 grams of an aqueous Black pigment dispersion (21 % solids) having a pH of 8.5 containing 6.7 grams of black Pigment regal 330 and 1.5 grams of cationic surfactant, SANIZOL B™, and 22 grams of a hydrodispersed styrene acrylic emulsion with a solids loading of 52 weight percent were added to 400 milliliters of water with high shear stirring using a polytron. The resulting mixture's pH was found to be pH 5.8. The pH of the mixture was reduced to 2.5 with the addition of 25 gms of 10 weight percent of citric acid in water. The resulting mixture was transferred to a 2-liter reaction vessel and heated at a temperature of 45° C. for 40 min resulting in a particle size of 5.7 microns with a GSD of 1.22 before 50 milliliters of a 20 percent aqueous NEOGEN R™ solution was added. Subsequently, the mixture was heated to 95° C. and held there for a period of 4.0 hours before cooling down to room temperature, and the pH of the mixture adjusted to 8.5 with a 3.5 weight percent w/w of water of potassium hydroxide stirred for 1 hr and filtered. The filter cake was redispersed in 1 liters of water with the aid of a mechanical stirrer, and the resulting toner slurry was brought to pH of 8.5 with dilute aqueous KOH solution, stirred for 60 minutes, and filtered. The filter cake was again redispersed in 1 liters of water, and the resulting toner slurry was brought to pH of 8.5 with dilute aqueous KOH solution, stirred for 60 minutes, and filtered. The washing was repeated twice in the same manner with water only, and there resulted a toner of the above resin 94 percent by weight and 6 percent by weight, and which toner possessed a particle size of 6.4 microns in volume average diameter and a particle size distribution of 1.22 as measured with a Coulter Counter.

For the toner of this Example, the tribo values at 20 and 80 percent relative humidity were, respectively, −46 and −17 microcoulombs per gram ($\mu$C/g).

EXAMPLE IV—(Magenta)

240.0 Grams of the latex A having a pH of 1.8 and 220.0 grams of a mixture of aqueous Red pigment dispersion containing 4.0 grams of Red Pigment 122, 2.7 grams of pigment Red 238 and 1.6 grams of cationic surfactant, SANIZOL B™, and 22 grams of a hydrodispersed styrene acrylic emulsion with a solids loading of 52 weight percent were added to 400 milliliters of water with high shear stirring using a polytron. The resulting mixture's pH was found to be pH 5.5. The pH of the mixture was reduced to 2.6 by the addition of 23 gms of 10 weight percent of citric acid in water. The resulting mixture was transferred to a 2-liter reaction vessel and heated at a temperature of 45° C. for 30 min resulting in a particle size of 5.7 microns with a GSD of 1.23 before 50 milliliters of a 20 percent aqueous NEOGEN R™ solution was added. Subsequently, the mixture was heated to 95° C. and held there for a period of 4.0 hours before cooling down to room temperature, and the pH of the mixture adjusted to 8.5 with a 3.5 weight percent w/w of water of potassium hydroxide stirred for 1 hr and filtered. The filter cake was redispersed in 1 liters of water with the aid of a mechanical stirrer, and the resulting toner slurry was brought to pH of 8.5 with dilute aqueous KOH solution, stirred for 60 minutes, and filtered. The filter cake was again redispersed in 1 liters of water, and the resulting toner slurry was brought to pH of 8.5 with dilute aqueous KOH solution, stirred for 60 minutes, and filtered. The washing was repeated twice in the same manner with water only, and there resulted a toner of the above resin 94 percent by weight and 6 percent by weight, and which toner possessed a particle size of 6.0 microns in volume average diameter and a particle size distribution of 1.22 as measured with a Coulter Counter.

For the toner of this Example, the tribo values at 20 and 80 percent relative humidity were, respectively, −48 and −20 microcoulomb per gram ($\mu$C/g).

EXAMPLE V

A cyan toner was prepared in accordance with the procedure of Example I except that there was selected a pigment dispersion comprised of submicron pigment particles of 150 nanometers size stabilized by hydroresin such as Flexverse™ comprised of a styrene acrylic copolymer available from Sun Chemicals instead of the usual alkylphenol ethoxylated nonionic surfactant used typically as pigment dispersants or stabilizers, also available from Sun Chemicals and there resulted a toner particle size of 5.9 micron in volume average diameter and a particle size distribution of 1.20 as measured on a Coulter Counter. The tribo values of the toner as evaluated according to the procedure of Example I were −56 $\mu$C/g and −22 $\mu$C/g at, respectively, 20 and 80 percent relative humidity.

EXAMPLE VI

A yellow toner was prepared in accordance with the procedure of Example II except that there was selected a pigment dispersion comprised of submicron pigment particles of size 200 nm stabilized by hydroresin Flexverse™ available from Sun Chemicals instead of an alkylphenol ethoxylated nonionic surfactant pigment dispersant, and there resulted a toner particle size of 5.9 micron in volume average diameter and a particle size distribution of 1.20 as measured on a Coulter Counter. The tribo values of the toner as evaluated according to the procedure of Example I were −64 $\mu$C/g and −28 $\mu$C/g at, respectively, 20 and 80 percent relative humidity.

EXAMPLE VII

A magenta toner was prepared in accordance with the procedure of Example VI except that there was selected a pigment dispersion comprised of submicron pigment particles of 180 nm particle size stabilized by hydroresin Flexverse™ available from Sun Chemicals instead of an alkylphenol ethoxylated nonionic surfactant pigment dispersant, and there resulted a toner particle size of 5.9 micron in volume average diameter and a particle size distribution of 1.20 as measured on a Coulter Counter. The tribo values of the toner as evaluated according to the procedure of Example I were −55 μC/g and −23 μC/g at, respectively, 20 and 80 percent relative humidity.

EXAMPLE VIII

A cyan toner was prepared in accordance with the procedure of Example I except that (I) there was selected a pigment dispersion comprised of submicron pigment particles stabilized by the hydroresin Flexverse™ available from Sun Chemicals instead of an alkylphenol ethoxylated nonionic surfactant pigment dispersant, also available from Sun Chemicals, (ii) no hydrodispersed styrene acrylic emulsion was utilized and the resultant pH of the mixture was reduced from 4.1 down to 2.6 using 12 mis of 10% citric acid w/w of water and there resulted a toner particle size of 6.0 micron in volume average diameter and a particle size distribution of 1.21 as measured on a Coulter Counter. The tribo values of the toner as evaluated according to the procedure of Example I were −40 μC/g and −18 μC/g at, respectively, 20 and 80 percent relative humidity.

EXAMPLE IX

A Yellow toner was prepared in accordance with the procedure of Example II except that (I) there was selected a pigment dispersion comprised of submicron pigment particles stabilized by the hydroresin Flexverse™ available from Sun Chemicals instead of an alkylphenol ethoxylated nonionic surfactant pigment dispersant, also available from Sun Chemicals, (ii) no hydrodispersed styrene acrylic emulsion was utilized and the resultant pH of the mixture was reduced from 4.8 down to 2.6 using 18 mis of 10% citric acid w/w of water and there resulted a toner particle size of 6.4 micron in volume average diameter and a particle size distribution of 1.21 as measured on a Coulter Counter. The tribo values of the toner as evaluated according to the procedure of Example I were −36 μC/g and −15 μC/g at, respectively, 20 and 80 percent relative humidity.

EXAMPLE X

A Magenta toner was prepared in accordance with the procedure of Example IV except that (I) there was selected a pigment dispersion comprised of submicron pigment particles stabilized by hydroresin Flexverse™ available from Sun Chemicals instead of an alkylphenol ethoxylated nonionic surfactant pigment dispersant, also available from Sun Chemicals, (ii) no hydrodispersed styrene acrylic emulsion was utilized and the resultant pH of the mixture was reduced from 4.4 down to 2.6 using 14 mls of 10% citric acid w/w of water and there resulted a toner particle size of 6.2 micron in volume average diameter and a particle size distribution of 1.22 as measured on a Coulter Counter. The tribo values of the toner as evaluated according to the procedure of Example I were −38 μC/g and −16 μC/g at, respectively, 20 and 80 percent relative humidity.

EXAMPLE XI

A cyan toner was prepared in accordance with the procedure of Example I except that there was selected Latex B, a pigment dispersion comprised of submicron pigment particles stabilized by hydroresin Flexverse™ available from Sun Chemicals instead of an alkylphenol ethoxylated nonionic surfactant pigment dispersant, and there resulted a toner particle size of 6.3 micron in volume average diameter and a particle size distribution of 1.21 as measured on a Coulter Counter. The tribo values of the toner as evaluated according to the procedure of Example I were −29 μC/g and −12 μC/g at, respectively, 20 and 80 percent relative humidity.

EXAMPLE XII

A Yellow toner was prepared in accordance with the procedure of Example I except that there was selected Latex B, a pigment dispersion comprised of submicron pigment particles stabilized by hydroresin Flexverse™ available from Sun Chemicals instead of an alkylphenol ethoxylated nonionic surfactant pigment dispersant, also available from Sun Chemicals and there resulted a toner particle size of 6.3 micron in volume average diameter and a particle size distribution of 1.21 as measured on a Coulter Counter. The tribo values of the toner as evaluated according to the procedure of Example I were −22 μC/g and −9 μC/g at, respectively, 20 and 80 percent relative humidity.

Comparative Example I 260.0 Grams of the above prepared latex A having a pH of 1.8 and 220.0 grams of aqueous cyan pigment mixture having a pH of 8.5, and the mixture comprising of 7.6 gram of Cyan pigment 15.3 dispersion (53.4% solids), 1.5 grams of cationic surfactant, SANIZOL B™, and 22 grams of the hydrodispersed styrene acrylic emulsion of 40 weight percent solids, and 189 grams of water, were added to 400 milliliters of water with high shear device such as a polytron. The resulting mixture's pH was found to be pH 5.8. The resulting mixture was transferred to a 2-liter reaction vessel and heated at a temperature of 45° C. for 5 minutes resulting in a particle size of 5.4 microns with a GSD of 1.40 by volume and 3.1 with GSD of 1.80 by number indicating a large number of fines present. The contents were allowed to aggregate for an additional 25 minutes and the particle size measurement resulted in a 5.8 micron with a GSD of 1.38 indicating very little improvement compared to the 5 minute sample with a particle size of 5.4 micron and a GSD of 1.40.

Comparative Example II 240.0 Grams of the above prepared latex A having a pH of 1.8 and 220.0 grams of an aqueous yellow mixture having a pH of 8.5, the mixture comprising 32 grams of a pigment Yellow 17 dispersion (28.8% solids), 1.8 gram of cationic surfactant, SANIZOL B™, and 22 grams of a hydrodispersed styrene acrylic emulsion with a solids loading of 52 weight percent, and 164 gram of water, were added to 400 milliliters of water with high shearing device such as, and preferably a polytron. The resulting mixture's pH was found to be pH 5.8. The resulting mixture was transferred to a 2-liter reaction vessel and heated at a temperature of 45° C. for 5 minutes resulting in a particle size (volume average throughout) of 4.9 microns with a GSD of 1.30 by volume and 3.7 with GSD of 1.82 by number indicating a large number of fines present. The contents were allowed to aggregate for an additional 25 minutes and the particle size measurement showed little or no improvement over the above 5 minute sample.

Comparative Example III 260.0 Grams of latex A having a pH of 1.8 and 250.0 grams of an aqueous cyan mixture having a pH of 8.5, which mixture comprises 7.6 gram of Cyan pigment 15.3 dispersion (53.4% solids) and 2.8 grams of the cationic surfactant, SANIZOL B™, and 70 grams of a hydrodispersed styrene acrylic emulsion with 16.5 weight percent solids and 180 grams of water, were added to 400 milliliters of water with high shear device such as a polytron. The resulting mixture's pH was found to be pH 4.8. The resulting mixture was transferred to a 2-liter reaction vessel and heated at a temperature of 40° C. for 5 minutes resulting in a particle size of 4.3 microns with a GSD of 1.35 by volume and 2.4 with GSD of 1.72 by number indicating a large number of fines present and the presence of a bimodal distribution. The mixture were allowed to aggregate for an additional 25 mins and the particle size measurement showed very little or no improvement, or change over the above 5 minute sample.

Comparative Example IV 260.0 Grams of the above prepared latex B having a pH of 1.9 and 220.0 grams of aqueous cyan pigment mixture having a pH of 8.5, and comprised of 7.6 gram of a the cyan pigment 15.3 dispersion (53.4% solids), 1.5 grams of the cationic surfactant, SANIZOL B™, and 22 grams of the hydrodispersed styrene acrylic emulsion with 40 weight percent solids, and 189 grams of water, were added to 400 milliliters of water with high shear polytron device. The resulting mixture's pH was found to be pH 5.8. The resulting mixture was transferred to a 2-liter reaction vessel and heated at a temperature of 45° C. (Centigrade) for 5 minutes while stirring, resulting in a particle size of 5.0 microns with a GSD of 1.42 by volume and 3.0 with GSD of 1.75 by number indicating a large number of fines present. The mixture was allowed to aggregate for an additional 25 minutes and the particle size measurement resulted in a 5.3 micron with a GSD of 1.40 indicating very little improvement compared to the 5 minute sample with a particle size of 5.0 micron and a GSD of 1.42.

Other modifications of the present invention may occur to those skilled in the art subsequent to a review of the present application. The aforementioned modifications, including equivalents thereof, are intended to be included within the scope of the present invention.

What is claimed is:

1. A process for the preparation of toner comprising blending a latex emulsion containing resin, with a colorant and from 2 to 30 weight percent of a hydroresin based on the total amount of the latex resin and the hydroresin; adding an acid to achieve a pH of about 2 to about 4 for the resulting mixture; heating at a temperature about equal to, or below about the glass transition temperature (Tg) of the latex resin; optionally adding an ionic surfactant stabilizer; heating at a temperature about equal to, or above about the Tg of the latex resin; and optionally cooling, isolating, washing, and drying the toner, and wherein the blend of the latex emulsion containing resin, and the colorant and hydroresin, possesses a pH of about 4.5 to about 6, the colorant is in the form of an aqueous dispersion, the heating and stirring the resulting mixture at a temperature about equal to, or below about the glass transition temperature (Tg) of the latex resin enables the formation of toner sized aggregates; the heating at a temperature about equal to, or above about the Tg of the latex resin enables the fusion or coalescence of the components of aggregates.

2. A process in accordance with claim 1 wherein said hydroresin contains from about 20 to about 300 of acid groups.

3. A process in accordance with claim 2 wherein about 25 to about 250 acid groups are present.

4. A process in accordance with claim 1 wherein the hydroresin is a styrene acrylic resin, an acrylate acrylic resin, or a butadiene acrylic resin.

5. A process in accordance with claim 1 wherein said hydroresin is readily dispersed or dissipated in a base solution of sodium hydroxide, poassium hydroxide, or ammonium hydroxide.

6. A process in accordance with claim 1 wherein the hydroresin is in the form of a rheology controlled (RC) material exhibiting newtonian behavior, and which hydroresin is comprised of an acrylic polymer, or a styrene acrylic polymer with an acid number in the range of about 15 to about 100.

7. A process in accordance with claim 1 wherein the hydroresin is of a Mw of from about 4,000 to about 300,000 and has a Tg of from about −18 to about +75 degrees C.

8. A process in accordance with claim 7 wherein the hydroresin is of a Mw of about 4,000 to about 200,000 and has a Tg of from about −16 to about +70 deg C.

9. A process in accordance with claim 1 wherein the colorant is in the form of a dispersion of colorant particles, wherein said particles are stabilized by said hydroresin.

10. A process in accordance with claim 1 wherein said toner is prepared by blending the colorant in the form of a dispersion with said latex emulsion by a high shearing device, and wherein the colorant dispersion is a pigment dispersion stabilized by a nonionic surfactant and optionally stabilized by hydroresin particles, and wherein said particles possess a volume average diameter of from about 0.05 to about 0.2 microns, and which colorant dispersion contains an ionic surfactant, and wherein the latex contains a nonionic surfactant and an ionic surfactant of opposite charge polarity to that of ionic surfactant in the colorant dispersion; followed by the reduction of the pH to from about 2 to about 3 by the addition of a dilute acid in the amount of about 0.5 to about 10 weight percent by weight of water; heating the resulting mixture at a temperature of about 30° C. to about 60° C. to effect formation of aggregates having a particle size of from about 2 to about 10 microns in volume average diameter with a narrow particle size distribution GSD of from about 1.12 to about 1.25 for said aggregates; heating the resulting aggregate suspension in the presence of an aggregate stabilizer to prevent, or minimize the aggregates from growing in size, and which heating is at a temperature of from about 65° C. to about 100° C.; and isolating the toner product, washing, and drying.

11. A process in accordance with claim 1 wherein the product toner size is from about 2 to about 10 microns, and said toner possesses a particle size distribution GSD of from about 1.12 to about 1.25.

12. A process in accordance with claim 1 wherein the latex contains a resin prepared by emulsion polymerization of vinyl monomers selected from the group consisting of styrene and substituted styrenes, 1,3-dienes, substituted 1,3-dienes, acrylates, methacrylates, acrylonitrile, acrylic acid, and methacrylic acid.

13. A process in accordance with claim 1 wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), and poly(butyl acrylate-isoprene); poly(styrene-propyl acrylate), poly(styrene-butyl acrylate), poly(styrene-butadiene-acrylic acid), poly (styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonotrile), and poly(styrene-butyl acrylate-acrylonotrile-acrylic acid), and wherein the resin is optionally present in an effective amount ranging from 80 percent by weight to about 98 percent by weight of toner.

14. A process in accordance with claim 1 wherein the colorant is carbon black, cyan, yellow, magenta, or mixtures thereof.

15. A process for the preparation of toner comprising blending a latex emulsion containing resin, with a colorant and from 2 to 30 weight percent of a hydroresin based on the total amount of the latex resin and the hydroresin; adding an acid to achieve a pH of about 2 to about 4 for the resulting mixture; heating at a temperature about equal to, or below about the glass transition temperature (Tg) of the latex resin; optionally adding an ionic surfactant stabilizer; heating at a temperature about equal to, or above about the Tg of the latex resin; and optionally cooling, isolating washing, and drying the toner, and wherein the blend of the latex emulsion containing resin, and the colorant and hydroresin, possesses a pH of about 4.5 to about 6, the colorant is in the form of an aqueous dispersion, the heating and stirring the resulting mixture at a temperature about equal to, or below about the glass transition temperature (Tg) of the latex resin enables the formation of toner sized aggregates; the heating at a temperature about equal to, or above about the Tg of the latex resin enables the fusion or coalescence of the components of aggregates, and wherein there is further added a nonionic surfactant to the latex emulsion selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; and wherein there is added to said blend an anionic surfactant selected from the group consisting of sodium dodecyl sulfate, sodium dodecylbenzene sulfate and sodium dodecylnaphthalene sulfate.

16. A process in accordance with claim 15 wherein the nonionic surfactant and anionic surfactant are each present in an amount of from about 0.01 to about 5 weight percent of the total reaction mixture.

17. A process for the preparation of toner comprising blending a latex emulsion containing resin, with a colorant and from 2 to 30 weight percent of a hydroresin based on the total amount of the latex resin and the hydroresin; adding an acid to achieve a pH of about 2 to about 4 for the resulting mixture; heating at a temperature about equal to, or below about the glass transition temperature (Tg) of the latex resin; optionally adding an ionic surfactant stabilizer; heating at a temperature about equal to, or above about the Tg of the latex resin; and optionally cooling, isolating, washing, and drying the resulting toner.

18. A process in accordance with claim 17 wherein said hydroresin contains from about 20 to about 300 acid groups.

19. A process in accordance with claim 17 wherein about 25 to about 250 acid groups are present.

20. A process for the preparation of toner comprising blending a latex emulsion containing resin, with a colorant; adding an acid to achieve a pH of about 2 to about 4 for the resulting mixture; heating at a temperature about equal to, or below about the glass transition temperature (Tg) of the latex resin; optionally adding an ionic surfactant stabilizer; heating at a temperature about equal to, or above about the Tg of the latex resin; and optionally cooling, isolating, washing, and drying the resulting toner, and wherein the colorant is in the form of a dispersion of colorant particles, and which particles are stabilized by a hydroresin.

21. A process for the preparation of toner comprising blending a latex emulsion containing resin, with a colorant; adding an acid to achieve a pH of about 2 to about 4 for the resulting mixture; heating at a temperature about equal to, or below about the glass transition temperature (Tg) of the latex resin; optionally adding an ionic surfactant stabilizer; heating at a temperature about equal to, or above about the Tg of the latex resin; and wherein said toner is prepared by blending the colorant in the form of a dispersion with said latex emulsion by a high shearing device, and wherein the colorant dispersion is a pigment dispersion stabilized by a nonionic surfactant and stabilized by hydroresin particles, and wherein said particles possess a volume average diameter of from about 0.05 to about 2 microns, and which colorant dispersion contains an ionic surfactant, and wherein the latex contains a nonionic surfactant and an ionic surfactant of opposite charge polarity to that of ionic surfactant in the colorant dispersion; followed by the reduction of the pH to from about 2 to about 3 by the addition of a dilute acid in an amount of about 0.5 to about 10 weight percent by weight of water; heating the resulting mixture at a temperature of about 30° C. to about 60° C. to effect formation of aggregates having a particle size of from about 2 to about 10 microns in volume average diameter with a narrow particle size distribution GSD of from about 1.12 to about 1.25 for said aggregates; heating the resulting aggregate suspension in the presence of an aggregate stabilizer to prevent, or minimize the aggregates from growing in size, and which heating is at a temperature of from about 65° C. to about 100° C.; and isolating the toner product, washing, and drying.

* * * * *